US007950378B2

(12) United States Patent
Casasso et al.

(10) Patent No.: US 7,950,378 B2
(45) Date of Patent: May 31, 2011

(54) GLOW PLUG CONTROL UNIT AND METHOD FOR CONTROLLING THE TEMPERATURE IN A GLOW PLUG

(75) Inventors: Paolo Casasso, Cuneo (IT); Stefano Cassani, Turin (IT); Angelo Argento, Turin (IT); Filippo Parisi, Turin (IT); Andrei Kanev, Turin (IT)

(73) Assignee: GM Global Technology Operations LLC, Detroit, MI (US)

( * ) Notice: Subject to any disclaimer, the term of this patent is extended or adjusted under 35 U.S.C. 154(b) by 82 days.

(21) Appl. No.: 12/356,728

(22) Filed: Jan. 21, 2009

(65) Prior Publication Data

US 2009/0183718 A1 Jul. 23, 2009

(30) Foreign Application Priority Data

Jan. 23, 2008 (GB) ..... 0801214.8

(51) Int. Cl.
*F02P 3/05* (2006.01)
*F23Q 7/00* (2006.01)

(52) U.S. Cl. ..... 123/623; 123/145 A; 701/102

(58) Field of Classification Search ..... 123/143 R, 123/145 A, 594–630, 179.6; 701/102, 113; 219/262, 483, 497

See application file for complete search history.

(56) References Cited

U.S. PATENT DOCUMENTS

| | | | | |
|---|---|---|---|---|
| 6,549,013 | B1 | 4/2003 | Uhl | |
| 6,635,851 | B2 * | 10/2003 | Uhl | 219/270 |
| 2008/0163840 | A1 * | 7/2008 | Toedter et al. | 123/145 A |
| 2010/0094523 | A1 * | 4/2010 | Kernwein et al. | 701/102 |

FOREIGN PATENT DOCUMENTS

WO 2007033825 A1 3/2007

OTHER PUBLICATIONS

British Patent Office, British Search Report for British Application No. 0801214.8, May 21, 2008.

* cited by examiner

*Primary Examiner* — Stephen K Cronin
*Assistant Examiner* — Johnny H Hoang
(74) *Attorney, Agent, or Firm* — Ingrassia Fisher & Lorenz, P.C.

(57) ABSTRACT

A glow plug control unit is provided that includes a first switch for connecting power supply lines to a glow plug. The glow plug control unit further includes a voltage measurement unit for measuring the voltage at the power supply lines. A current measurement unit is built for measuring the current through the first switch and a control circuit is built for controlling the first switch and, in a current control mode, for regulating the current through the first switch.

19 Claims, 7 Drawing Sheets

GLOW PLUG CONTROL UNIT AND METHOD FOR CONTROLLING THE TEMPERATURE IN A GLOW PLUG

CROSS-REFERENCE TO RELATED APPLICATION

This application claims priority to United Kingdom Patent Application No. 0801214.8, filed Jan. 23, 2008, which is incorporated herein by reference in its entirety.

TECHNICAL FIELD

The invention relates to glow plug control unit and method for controlling the temperature in a glow plug.

BACKGROUND

WO 2007/033825 shows a control of a group of glow plugs for a diesel engine. The glow plugs are periodically connected with supply lines according to pulse-width modulated signals. To provide the glow plugs with the required energy, the voltage drop over the supply lines is calculated by the help of the measured glow plug current. This calculation is done for each glow plug individually to control its temperature. The method is well adapted for ceramic glow plugs of which the resistance strongly varies over the temperature. On the other hand, this method uses a calculation based on a number of measurements and estimations including the risk that the control of the temperature is wrong.

It is accordingly at least one object of the invention to provide an alternative glow plug control unit that provides a more precise control of the temperature of the glow plugs. It is at least another object of the invention to provide a method for controlling a glow plug more precisely. In addition, other objects, desirable features, and characteristics will become apparent from the subsequent summary and detailed description, and the appended claims, taken in conjunction with the accompanying drawings and this background.

Embodiments of the invention provide a glow plug control unit that comprises a first switch for connecting a power supply node to a glow plug. The glow plug control unit further comprises a voltage measurement unit for measuring the voltage at the power supply lines. A current measurement unit is built for measuring the current through the first switch and a control circuit is built for controlling the first switch and, in a current control mode, for regulating the current through the first switch to a predefined value.

The resistance of metallic glow plugs is relatively stable at different temperature conditions compared to the resistance of ceramic glow plugs. The inventive glow plug control unit provides the current control mode in which the current through the glow plugs is regulated directly. The power in the glow plugs and the temperature is accordingly controlled by the help of the current measurement and the current control does not need to compensate the voltage drops. The compensation of the voltage drops needs a series of calculations which may be faulty because they are based on estimations and prior measurements of the resistance. The current control mode is used preferably for metallic glow plugs, as their resistance is relatively stable over temperature.

In an embodiment, the first switch comprises a transistor and the current measurement unit comprises a current mirror mirroring the current through the transistor of the first switch. A current mirror provides a direct measurement of the current through the first switch, which is equal to the current through the glow plug.

Preferably, the glow plug control unit comprises a second switch between the battery and the power supply node. This additional, second switch, may open and close the supply path between the battery and the glow plug. The second switch is a redundant to block the current flow independently of the status of the control circuit.

The current is also measured when the first switch is switched off. This makes it possible to check if no current flows through the first switch in the off-periods.

In an embodiment, the control circuit regulates the voltage at the glow plugs in a voltage control mode. This additional mode may preferably be used for ceramic glow plugs. The resistance of the ceramic glow plug depends strongly on the glow temperature. Accordingly, to calculate the power in the glow plugs, the voltage at the glow plugs needs to be taken into account. Thus, the voltage control mode is needed to support glow plugs having a resistance value varying with the temperature.

In an additional mode, the power control mode, the power in the glow plugs is regulated to a predetermined value. Shifts in the resistance of the glow plugs may be compensated because the measured voltage depends on this resistance.

To regulate the power to a predefined value, the power in the glow plug is estimated based on the current through the first switch and based on the voltage at the first switch.

The invention also relates to a method for controlling a glow plug with a glow plug control unit, and an inventive glow plug control unit is provided and the current through the first switch is measured. Then, in a current control mode, the current through the first switch is regulated to a predetermined value.

Preferably, the first switch of the glow plug control unit being provided comprises a transistor. The current through the first switch is measured by a current mirror mirroring the current through the transistor.

The invention also provides a method for calculating the power in a glow plug. First, a glow plug control unit for a plurality of glow plugs is provided. The glow plug control unit comprises a plurality of switches, each of the switches for connecting a glow plug to a power supply node. The current through the glow plugs is measured and the voltage at the glow plugs is calculated by calculating the voltage drop at power supply node based on the current through the switches being switched on concurrently. The power in the glow plugs is calculated based on the calculated voltage at the glow plugs and the measured current through the glow plugs.

If the on-times of the switches party overlap, the voltage drop at the power supply node varies over time. As the number of measurement samples is limited, one sample is used to estimate the voltage of a complete period. When the number of switches being switched on concurrently differs during the period, the voltage drop varies and the sample does not provide the correct value for the complete period. Thus, the voltage drop is calculated based on the number of switches being switched on concurrently to compensate this effect.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background and summary or the following detailed description.

Figure 1:
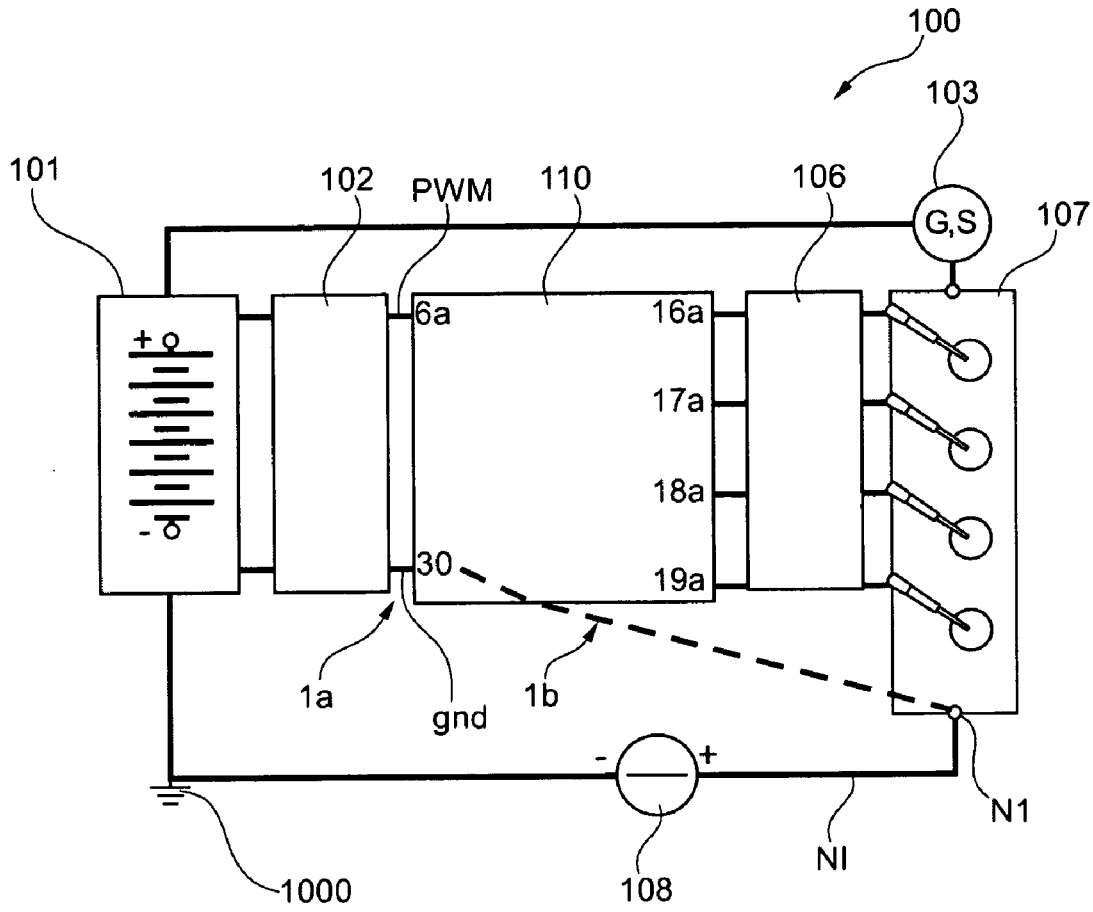
FIG. 1 shows an engine control module in which the control apparatus of the glow plugs is integrated.

FIG. 1 shows a control module 100 in which the control apparatus for the glow plugs is integrated. The engine control module 100 comprises a battery 101, a power supply wiring harness block 102, a generator and starter block 103, a control unit 110, a glow plug wiring harness 106, a glow plug and cylinder chamber 107 with the glow plugs A, B, C and D and a resistive path 108.

The battery 101, as the system power supply, is connected with its negative pole to the chassis ground 1000 and with its positive pole to the generator and starter block 103. The negative and positive poles of the battery are also connected to the power supply wiring harness block 102. This power supply wiring harness block 102 comprises the wiring harness and the fuses for the supply lines.

The wiring harness block 102 outputs the supply signals pwr and gnd to the control unit 110 that are connected to these signals at its inputs 6*a* respectively 30. The control unit 110 is also connected at its outputs 16*a*, 17*a*, 18*a*, and 19*a* to the glow plugs wiring harness 106 providing the connection to the glow plugs A, B, C and D of the glow plugs & cylinders chamber 107.

The glows A, B, C and D are further connected to the node N1 that couples them to the chassis ground 1000 via the resistive path 108. The resistive path 108 is the path in the chassis that connects the negative pole of the battery 101 with the node N1 close to the glow plugs A, B, C and D.

FIG. 1 shows the option 1*a* for the ground connection of the control unit 110. The dashed line marks the second option 1*b* in which the input 6*a* of the control unit 110 is connected to the node N1 and not to an output of the power supply wiring harness block 102.

FIG. 1 shows a full integration of the glow plugs control inside the control module 100. The control apparatus has been defined to support various methods for controlling the glow temperature. These methods are applied depending on the engine conditions and on the environmental conditions. The control apparatus is able to manage both metallic and ceramic glow plug technologies. FIG. 1 shows an engine control for four cylinders and four glow plugs A, B, C and D. The control apparatus is modular such that it may be adapted to glow plug systems of diesel engines with 2, 3, 4, 6 and 8 cylinders. The cylinders may be split into banks.

Figure 2:
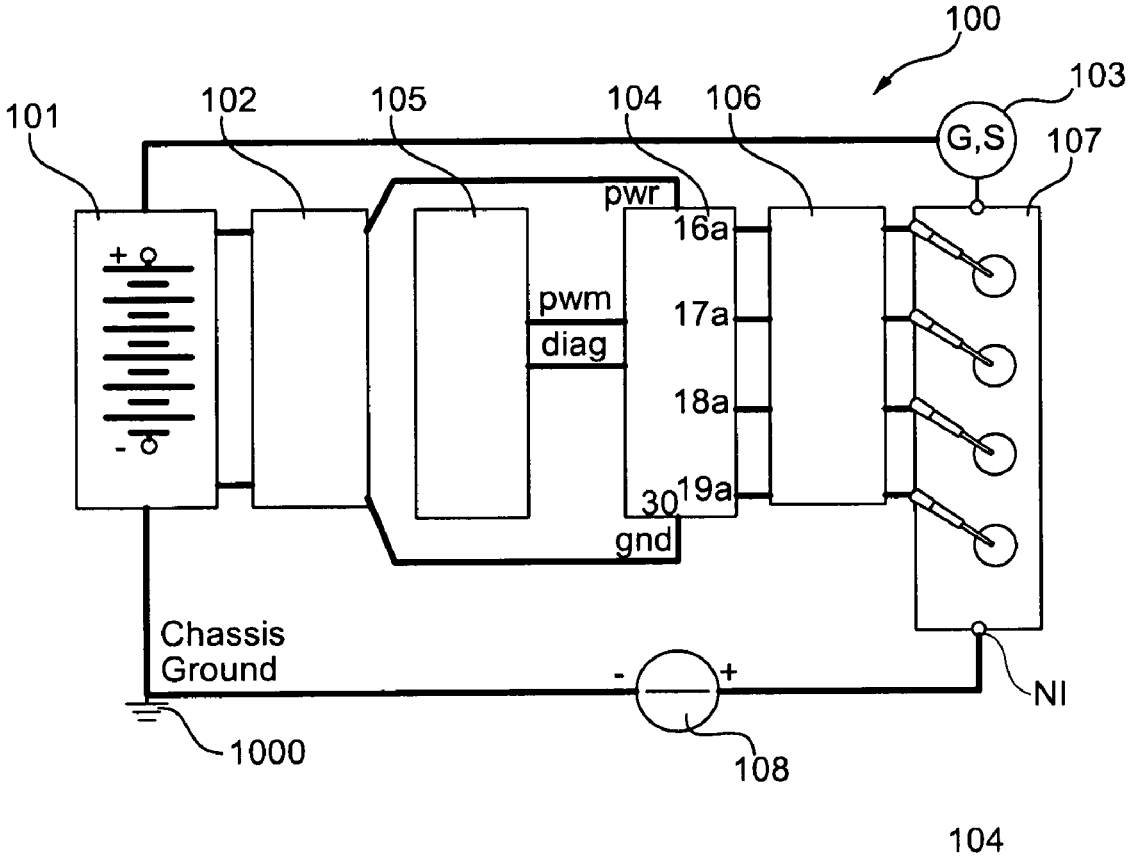
FIG. 2 shows a second engine control module with an integrated control apparatus for the glow plugs.

FIG. 2 shows the engine control module 100 of FIG. 1 in which the control unit 100 is split in a glow plug control unit 104 and an engine control module 105. The engine control module 105 controls the engine e.g. the volume of fuel to be injected, whereas the glow plug control unit 104 controls the temperature of the glow plugs.

The glow plug control unit 104 is connected to the engine control module 105 via the signals pwm and diag. The signal diag is used for diagnostic purpose to send an error message from the glow control unit 104 to the engine control module 105. By the signal pwm the engine control module 105 requests the glow plug control unit 104 to heat the glow plugs.

The control apparatus is applicable to both glow plugs system showed in FIG. 1 and FIG. 2 and may also be implemented in a stand-alone glow plug control unit with some restrictions due to the typically limited interaction with the engine control module.

Figure 3:
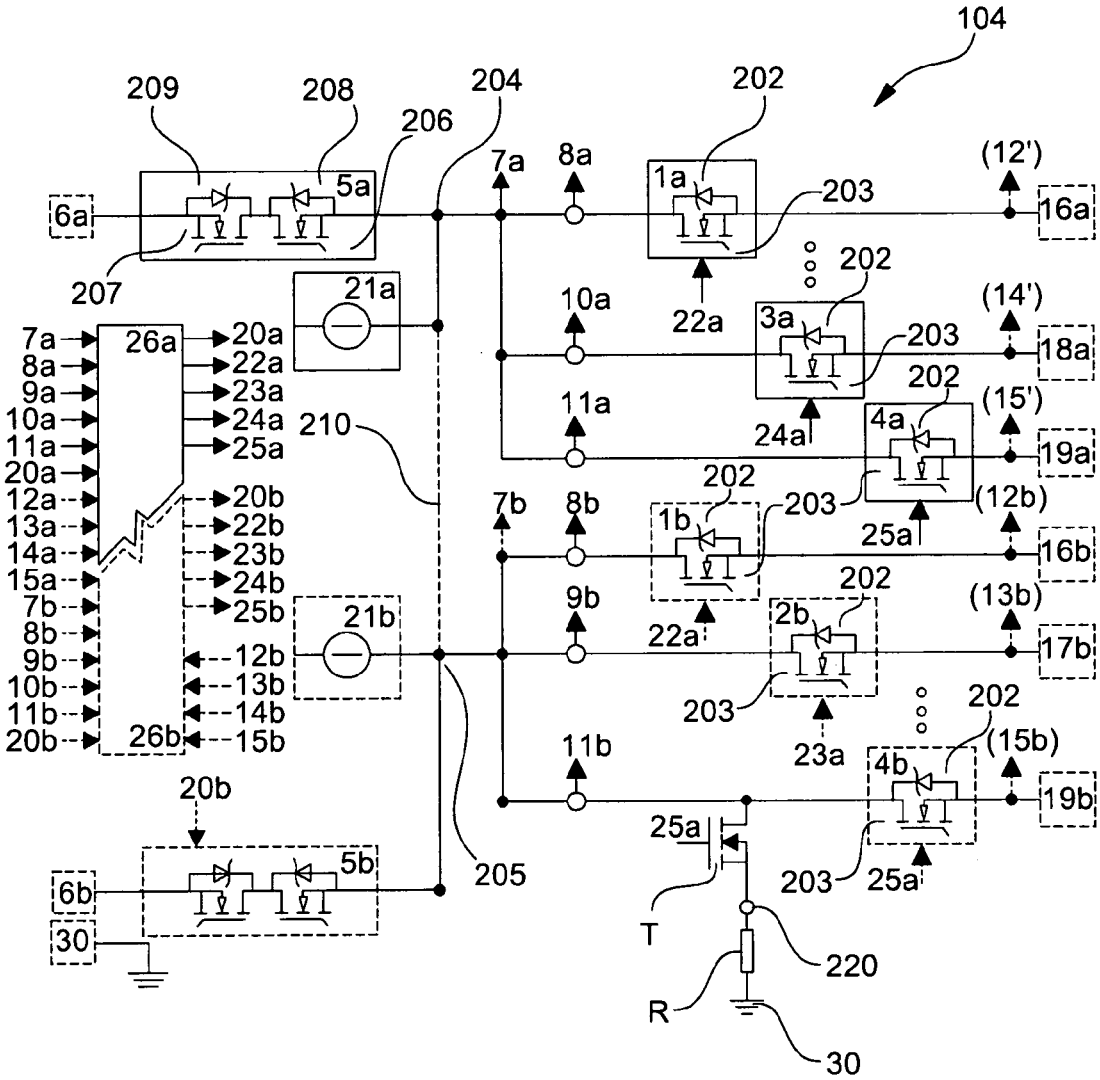
FIG. 3 shows an engine control module of FIG. 1 with further details.

The schematic in FIG. 3 shows a multi-cylinder glow plug control unit 104, whereby the characters a and b identify one of two banks, the brackets ( )stand for optional elements and the hyphens --- identify elements that are added if the numbers of cylinders of the engine is high. The glow plug control unit 104 is designed for an engine with eight glow plugs. The glow plugs of the banks are called A, B, C and D and those of bank b Ab, Bb, Cb, Db.

The glow plug control unit 104 comprises a first unidirectional enable switch 5*a* and a second unidirectional enable switch 5*b*, the first, second, third, fourth, fifth and sixth high side switches 1*a*, 2*b*, 3*a*, 4*a*, 1*b* and 4*b*. Each of the high side switches 1*a*, 2*b*, 3*a*, 4*a*, 1*b* and 4*b* comprises an n-channel enhancement MOS-field effect transistor 203 and a flyback diode 202. The drain of the transistor 203 is connected to the cathode of the diode 202, whereas the source of the transistor 203 is connected to the anode of the diode 202. The high-side switches 2*a* and 3*b* are not shown in FIG. 3 but are further high-side switches connecting the power supply node 204 and 205 to the glow plugs B and Cb, respectively.

Each of the unidirectional enable switches 5*a* and 5*b* comprises a first transistor 206 and a second transistor 207, a first diode 208 and a second diode 209. The source of the first transistor 206 is connected to the anode of the first diode 208. The drain of the first transistor 206 is connected to the cathodes of the first diode 208 and of the second diode 209 and to the drain of the second transistor 207. The source of the second transistor 207 is connected to the anode of the second diode 209. The source of the second transistor 207 of the first unidirectional enable switch 5*a* is connected to the input 6*a*, whereas the source of the first transistor 206 of the first unidirectional enable switch 5*a* is connected to the power supply node 204. The source of the second transistor 207 of the second unidirectional enable switch 5*b* is connected to the input 6*b*, whereas the source of the first transistor 206 of the second unidirectional enable switch 5*b* is connected to the node 205.

The power supply input terminal 6*a* is connected to the node pwr to establish a low impedance path to the positive pole of the battery 101.

The ground reference terminal 30 is connected to the node gnd. This establishes a low impedance return path to the battery negative pole. The node gnd is the reference node for all the control architecture related voltages.

The first unidirectional enable switch 5*a* has a redundant switch off capability and the reverse polarity protection necessary for the direct battery connection at the power supply input terminal 6*a*. By the unidirectional enable switch 5*a* the current flow into the glow plugs may be blocked independently of the status of the engine control module 105.

The gates of the first transistor 206 and of the second transistor 207 are controlled by the signal first unidirectional enable switch control 20*a* for the first unidirectional enable switch 5*a* and by the signal second unidirectional enable switch control 20*b* for the second unidirectional enable switch 5*b*. The unidirectional enable switches 5*a* and 5*b* are closed to provide the voltage at the nodes 204 and 205.

The output terminal 16*a* is connected to the glow plug A, the output terminal 18*a* is connected to the glow plug C, the output terminal 19*a* is connected to the glow plug D, the output terminal 17*b* is connected to the glow plug Bb and the output terminal 19*b* is connected to the glow plug Db.

The gates of the transistors 203 of the high-side switches 1*a*, 2*b*, 3*a*, 4*a*, 1*b* and 4*b* are controlled by the signals high side switches control 22*a*, 23*a*, 24*a* and 25*a*, such that the transistor gate of the high-side switch 1*a* and of the high side enable switch 1*b* are controlled by the high side switch control 22*a*. The transistor gate of the high-side enable switch 3*a* is controlled by the high side switch control 24*a*, that of the high-side enable switch 2*b* by the high side switches control 23*a* and those of the high-side enable switches 4*a* and 4*b* by the high side switches control 25*a*.

The high side switches 1*a*, 2*b*, 3*a*, 4*a*, 1*b* and 4*b* provide the capability, via the high side switch control signals 22*a*, 24*a* and 25*b*, to energize the glow plugs A, B, C, D switching the voltage at the power supply node 204 respectively 205 to the output 16*a*, 18*a*, 19*a*, 16*b*, 17*b* and 19*b*. They also provide the capability to adapt the voltage slew-rate for both on/off and off/on transitions to limit the power dissipation. The voltage slew-rate depends on the environmental conditions.

The high side switches control 22*a*, 23*a*, 24*a* and 25*a* controls the high-side switches 1*a*, 2*b*, 3*a*, 4*a*, 1*b* and 4*b* independently to transfer the voltage to each glow plug A, B, C, D, Ab, Bb, Cb and Db. In this embodiment, the high side switches control 22*a*, 23*a*, 24*a* and 25*a* are driven by pulse-width modulated signals providing a defined current to the glow plugs and also providing a defined voltage when the high-side switches 1*a*, 2*b*, 3*a*, 4*a*, 1*b* and 4*b* are switched on.

The enable voltage monitor 7*a* monitors the voltage at the node 204 and the enable voltage monitor 7*b* monitors the voltage at the node 205. In an embodiment, these voltage monitors 7*a* and 7*b* output the maximal and the minimal values of the voltage at the nodes 204 and 205 during the on time of the pulse width modulated command for the glow plugs.

The current monitors 8*a*, 8*b*, 9*b*, 10*a*, 11*a* and 11*b* monitor the current flowing through each high side switches 1*a*, 1*b*, 2*b*, 3*a*, 4*a* and 4*b* during both on and off periods of the pulse width modulated command. The current monitors 8*a* and 8*b* are preferably current mirrors mirroring the current through the transistors 202 of the high side switches. In an embodiment, each current monitor 8*a* and 8*b* reports the maximal values for both, the on-periods and the off-periods.

The transistor T shows an embodiment of a current mirror used as a current monitor. The transistor T has the same size as the transistor 203 of the high side switch 4*b*. Its drain is connected to the node 205, whereby its source is connected to node 220. The gate is controlled by the signal high side switch control 25*a*. A resistor R is provided between the node 220 and the reference ground terminal 30. The resistor R is adjustable such that the voltage at node 220 is regulated to a voltage having the same value as the voltage at the output terminal 19*b*. As the transistor T has the same size and the same voltage conditions as the output terminal 19*b*, the current through this transistor is the same as the current through the high side switch 4*b*. This current may be calculated by diving the voltage at node 220 by the resistance of the resistor R.

The output values of the current monitor 8*a*, 10*a*, 11*a*, 8*b*, 9*b* and 10*b* are captured at the same time at which the respective enable voltage monitors 7*a* and 7*b* detect the maximal voltage value for each the pulse width modulated command provided at the high side switch control 22*a*, 23*a*, 24*a* and 25*a*.

During the off periods, the current measured by the current monitors 8*a* and 8*b* should be zero. The current measured by the current monitors 8*a* and 8*b* during these periods have no impact on the control function, but are used for diagnosis purposes.

The dashed line 210 shows an optional connection that short-cuts the nodes 204 and 205. In this case, the second unidirectional enable switch 5*b* will be deleted and the node 205 will also be supplied by the first unidirectional enable switch 5*a*.

The biasing networks 21*a* and 21*b* monitor the voltage supplied to the high side switches 1*a*, 2*b*, 3*a*, 4*a*, 1*b* and 4*b* when the unidirectional enable switch is not active. This has no impact on the control function but is also used for diagnosis purposes.

The control logic 26 provides the control methods to drive the unidirectional enable switch controls 20*a* and 20*b* and the high side switches controls 22*a*, 23*a*, 24*a* and 25*a* based on the engine operating conditions, on the environmental conditions, on the glow plug type respectively depending on the information received from the voltage monitors 7*a* and 7*b* and the current monitors 8*a*, 10*a*, 11*a*, 8*b*, 9*b* and 11*b*.

The secondary voltage monitors 12', 14', 15', 12*b*, 13*b* and 15*b* provide an alternative method to monitor the output voltages at the output terminal 16*a*, 18*a*, 19*a*, 16*b*, 17*b* and 19*b* during both on and off periods of the respective pulse width modulated command. The information generated at the off periods permits to compensate the voltage ground shift between engine block and chassis ground 1000 if necessary.

The functional targets of the control can be summarized by the following aspects: The target temperature should be reached quickly. However, dangerous temperature overshoot should be avoided. Further, the temperature should be kept within a defined range depending on the engine operating conditions.

Figure 4:
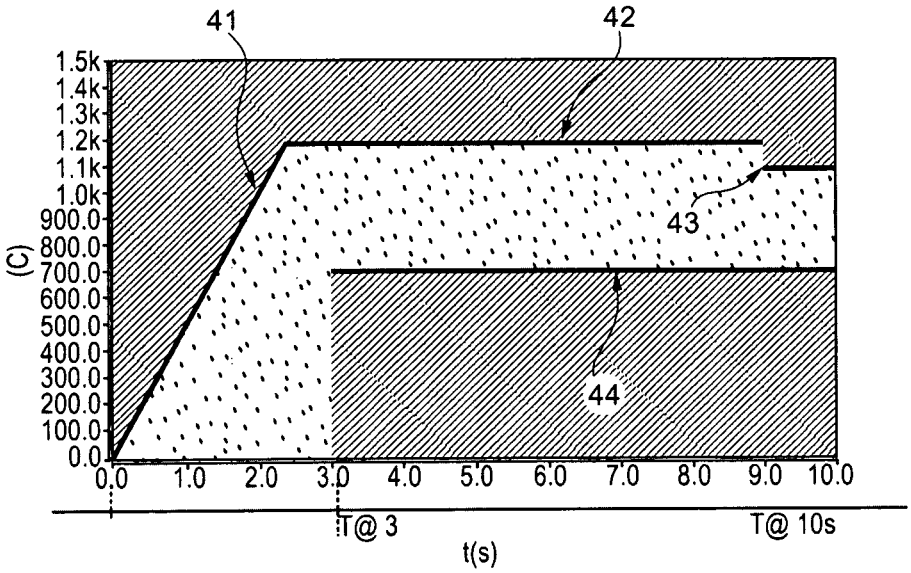
FIG. 4 shows a specification for the temperature of the glow plugs.

FIG. 4 shows an example of temperature mask that defines the boundaries for the glow temperature of the glow plugs. At the time t=0 s, the temperature of the glow plugs is close to zero degree Celsius. The maximal slew rate of the temperature is 1200° C. per 2.2 s. From 3 s on, the temperature of the glow plugs must have reached 700° C. and must not fall below this temperature. From the 3 s to 9 s, the temperature must not overshoot 1200° C. and after 9 s, the maximal temperature is set to 1100° C.

The control apparatus permits via the pulse width modulated output commands that are provided as high side switches control signals 22*a*, 23*a*, 24*a* and 25*a* to control the temperature of each individual glow plug. Depending on the engine operating condition and on the glow plug technology, the control logic shall select the most efficient method to control and to drive the glow plugs.

The four control methods being supported by this control architecture are 1) the inrush energy control, 2) the effective voltage closed loop, 3) the effective glow plug current closed loop and 4) the output power closed loop.

Figure 5:
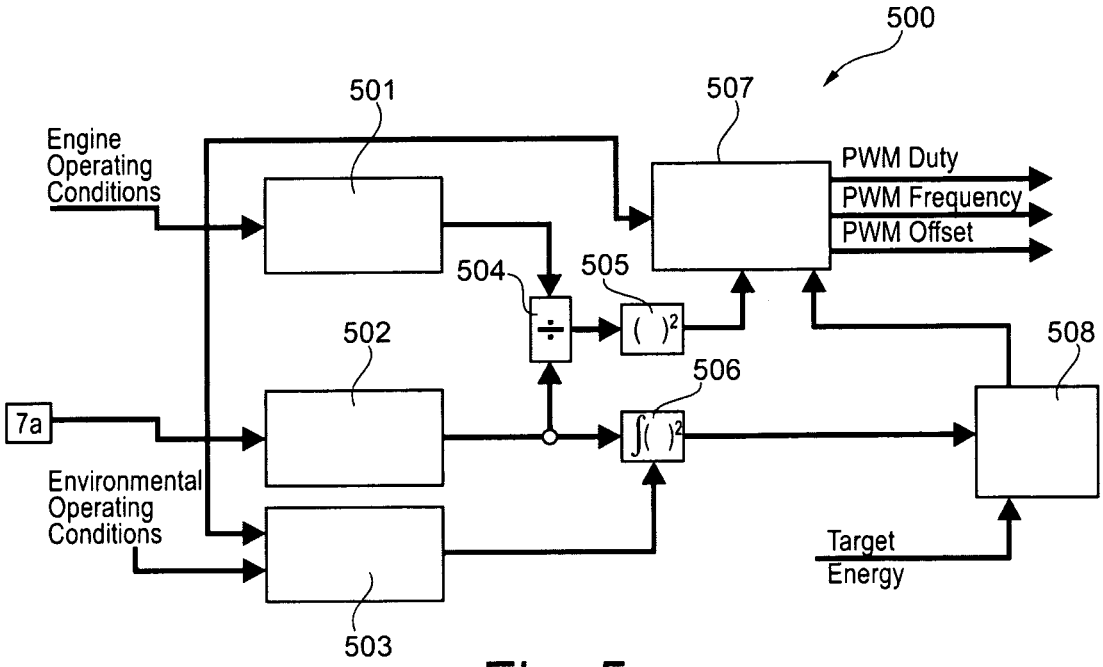
FIG. 5 shows a schematic for the control apparatus in a first control mode.

FIG. 5 shows in a schematic overview of the control circuit 500 for the first method, the inrush energy control. The control circuit 500 controls the temperature of one single glow plug: A glow plug control for eight glow plugs comprises eight of these control circuits 500. The control circuit 500 comprises a voltage set-point calibration 501, a voltage estimation 502, a thermal status estimation 503, a divider 504, a multiplier 505, an integrator 506, a PWM generation 507 and a comparator 508. PWM stands for pulse-width modulated signal.

The voltage set-point calibration 501 receives the engine operation conditions, in this case the information that the engine is in the inrush phase. The voltage set point calibration 501 outputs the value voltage set point that represents the requested voltage for the given engine operation condition.

The voltage estimation 502 receives from the voltage monitor 7*a* the voltage that is measured at the power supply node 204. From this value, the voltage estimation 502 outputs a value representing the estimation of the voltage at the glow plug A. The estimated voltage is received by the integrator 506 which first squares the estimated voltage and then integrates the result of the square operation. By this operation, the energy being provided to the glow plug since the start of the engine is summed up.

The thermal status estimation 503 receives the engine operation conditions and the environmental operating conditions, especially the external temperature and the speed of the wind. If the engine operating conditions indicate that the engine was just started, the glow plug temperature is estimated to be the same as the external ambient temperature.

The estimated temperature of the glow plug is used as a start value for the integration in the integrator 506. The integrated energy is compared with a predetermined target value for the energy in the comparator 508. If the energy is below the target energy, the comparator 508 sends an output signal to the PWM generator 507 to open the high-side switch 1*a*.

The high-side switch 1*a* will be closed if the voltage at the glow plugs exceeds a threshold voltage defined by the voltage set point. To detect this condition, the divider 504 divides this estimated voltage by the voltage set point and outputs its result to the multiplier 505 which sets the PWM generator 507 that generates a parameters PWM duty cycle, PWM frequency and PWM offset. These parameters are used to generate the signal high side switch control 22*a*.

The inrush energy control is used when a fast energizing of the glow plugs is requested, mainly in the inrush phase. The control circuit will provide an amount of energy depending on environmental and engine operating conditions, on the estimated initial thermal status of the glow plug and on the glow plug characteristics. The real-time energy transferred to the glow plug, called normalized energy, is calculated by integrating the square of the estimated effective voltages applied to the glow plugs. The control also limits the effective voltage applied to the glow plugs to avoid excessive thermal gradients during this phase.

Figure 6:
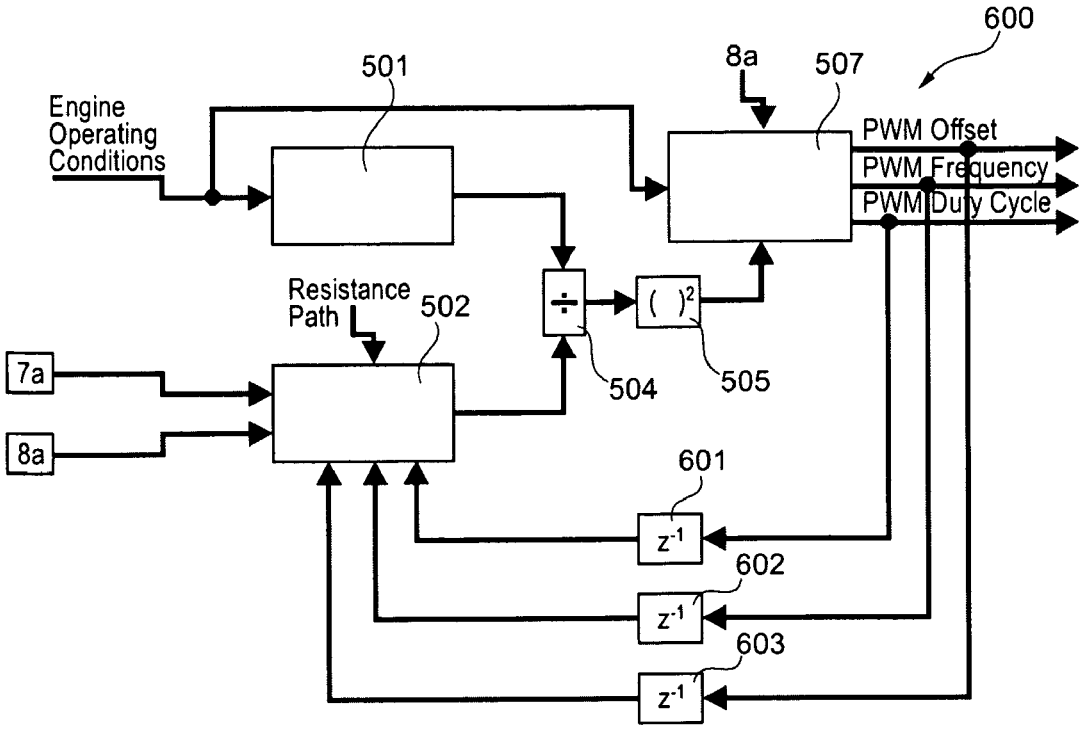
FIG. 6 shows a schematic for the control apparatus in a second control mode.

FIG. 6 is a schematic overview of a control circuit according to the second method, the effective voltage closed loop. Elements with same functions as in the preceding figures are referenced with the same reference numbers.

The voltage control 600 provides to each glow plug a predetermined effective voltage depending on the engine operating conditions and on the temperature target. The voltage estimation 502 receives the voltage measured by the voltage monitor 7*a*. From this feedback signal, the voltage at the glow plug A is calculated.

The estimated voltage is divided by the output value of the voltage set point 501, the result of this operation is squared and then output as a duty cycle to the PWM generator 507. The PWM generator 507 defines the parameters frequency, offset and duty cycle for the generation of a pulse width modulated signal first high-side switch control 22*a*. The glow plug A is opened and closed according to this signal providing a defined voltage at the glow plug A.

The blocks 601, 602 and 603 feedback the parameters PWM offset, PWM frequency and PWM duty cycle. The feedback is used to ensure that these parameters do not exceed an upper limit.

To calculate the voltage being applied to the glow plug, the voltage drop over the glow plug wiring harness 106 is compensated. Accordingly, the output of current monitor 8*a* and a value for the resistance of the glow plug wiring harness 106 is input to the voltage estimation 502.

As an option, the voltage drop across the high side switch 1*a* is also compensated. The voltage drop may be calculated by the difference between the voltage monitor 7*a* and the voltage monitor 12' when the high-side switch 5*a* is on. The voltage drop varies over the temperature, accordingly the estimated temperature of the high-side switch may also be considered. It also should be considered that the voltage drop highly depends on the current through the high-side switch 1*a*. Therefore, the voltage drops should be measured at different currents.

In addition, the voltage drop across the resistive path 108 may be compensated using the current monitor 8*a* feedback during the on periods of the pulse width modulated commands. Optionally, the duty cycles of the pulse width modulated commands may be limited by an upper limit to avoid excessive currents.

Figure 7:
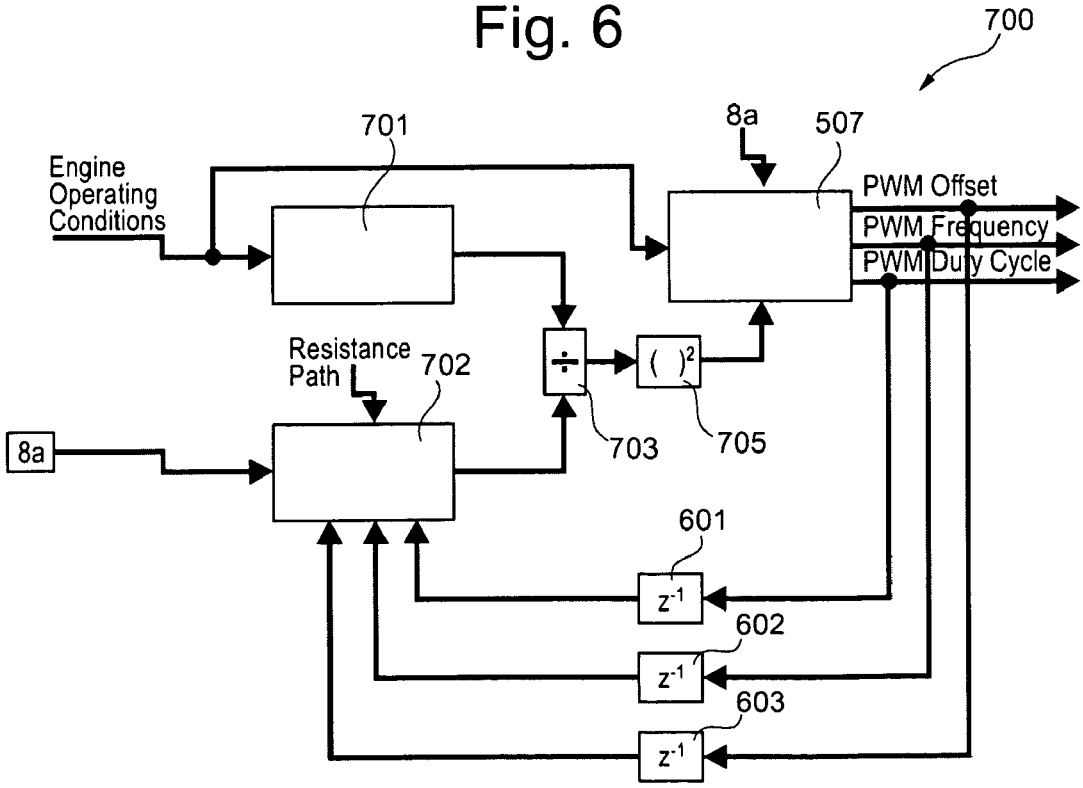
FIG. 7 shows a schematic for the control apparatus in a third control mode.

FIG. 7 shows the current control circuit 700 for the third method using the effective glow plug current closed loop. The current control circuit 700 comprises a current set point calibration 701, a current estimation 702, a divider 703, a multiplier 705 and a PWM generator 507.

The current estimation 702 receives the current measured by the current monitor 8*a*. From this feedback signal, the current through the glow plug A is calculated. The estimated current is divided by the output value of the current set point calibration 701, the result of this operation is squared in the multiplier 705 and then output as a duty cycle to the PWM generator that outputs the parameters PWM frequency, PWM offset and PWM duty cycle for the generation of a pulse width modulated signal first high side switch control 22*a*. The glow plug A is opened and closed according to these signals providing a defined current at the glow plugs.

The current control circuit 700 provides an effective current to the glow plug, using the current monitor 8*a* feedback during the on periods of the pulse width modulated commands. This method is typically applied if the equivalent electrical resistance does not dependent too much on the electrical power supplied to the hot glow plug A.

In contrast to the voltage closed loop control, the compensation of voltages drop across the resistive path between the monitoring point and the glow plug is not necessary.

Figure 8:
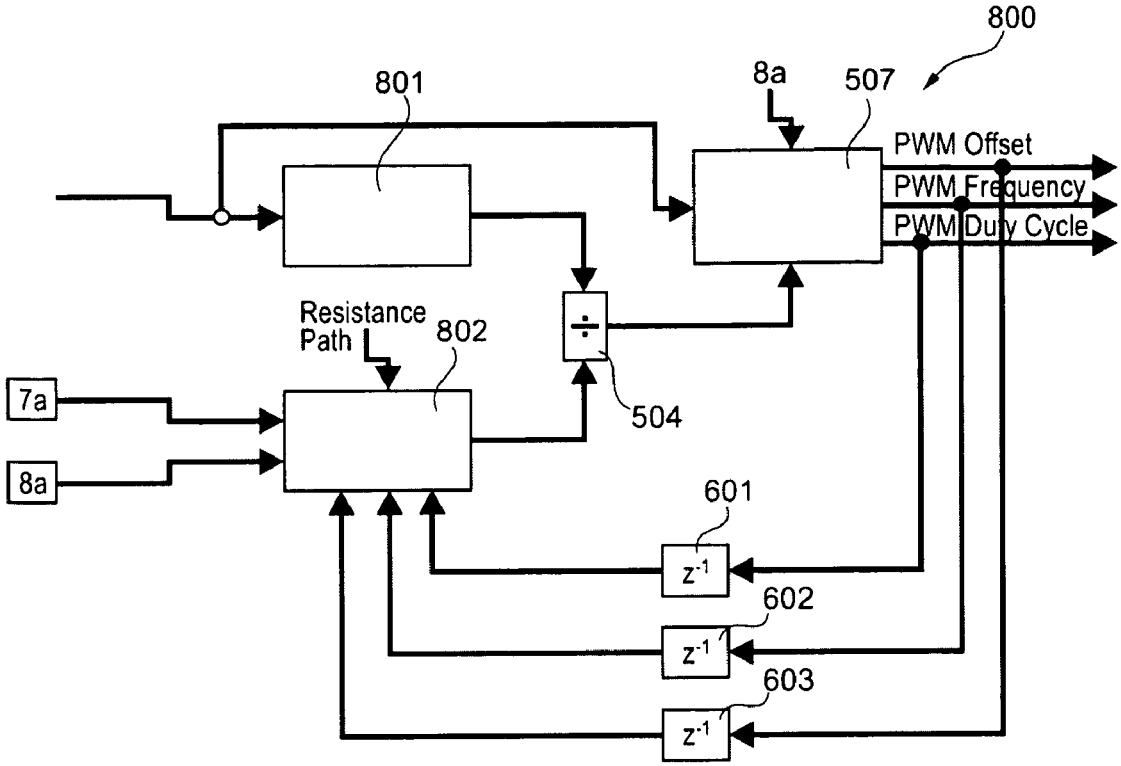
FIG. 8 shows a schematic of the control apparatus in a fourth control mode.

The fourth method, the output power closed loop, is provided by the power control circuit 800 shown in FIG. 8. The control circuit 800 includes a power set-point calibration 801, a power estimation 802, a divider 504 and a PWM generator 507. The power estimation 802 receives the voltage measured from the voltage monitor 7*a* and the current measured by the current monitor 8*a*. The power estimation multiplies these two values to output an estimated power for the glow plug A. The estimated power is divided in the divider 504 by the output of the power set-point calibration 801 that is set according to the engine operation conditions.

The result of this division is used to generate the parameters PWM offset, PWM frequency and PWM duty cycle in the PWM generator 507. In contrast to the first method, the inrush energy control, only the power being actually supplied is regulated. In the inrush energy control, the energy was integrated since the beginning of the inrush phase.

The control circuit 800 provides a defined power to each glow plug, using the current monitor 8*a* feedback during the on periods of the pulse width modulated commands and the voltage monitor 7*a* feedback.

As an option, the voltage drop across internal High Side Switches is compensated, in a further option the voltage drop across external wiring harness is compensated using the current monitor 8*a* feedback, optionally limiting the duty cycles of the pulse width modulated commands to avoid excessive currents.

The following electrical effects may be compensated by the above-described control methods: supply voltage variation, ground shift, high side switch Rdson voltage drop, wiring harness losses and voltage variations during command overlaps and during PWM frequency modulation.

The thermal/fluid dynamic effects air flow cooling effect, combustion heat release and the initial thermal variations may also be compensated.

The control methods 2) and 4) compensate supply voltage variations at the power supply input terminal by the help of the voltage monitor 7*a* feedback.

The ground shift between the node gnd and the negative pole of the battery may be compensated by help of the output voltage monitor 12', 14', 15', 12*b*, 13*b*, 15*b* feedbacks measured during the off periods of the pulse width modulated commands.

With the control methods 2), 3) and 4) voltage drops on the internal high side switches are also compensated. The voltage drops over the high side switches is measured by the voltage monitors 12', 14', 15', 12*b*, 13*b* and 15*b* when the high side switches are on.

All control methods 1), 2) and 4) compensate the voltage drops over the external wiring harness of the power supply wiring harness block 102 because the current monitor 8*a* feedbacks the actual current during the on periods of the PWM commands. The voltage drop over the external wiring harness in the power supply wiring harness block 102 may be calculated by multiplying the sum of currents through the high-side switches by a resistance that is based on parameters identifying the values of the wiring harness path resistance.

Figure 9:
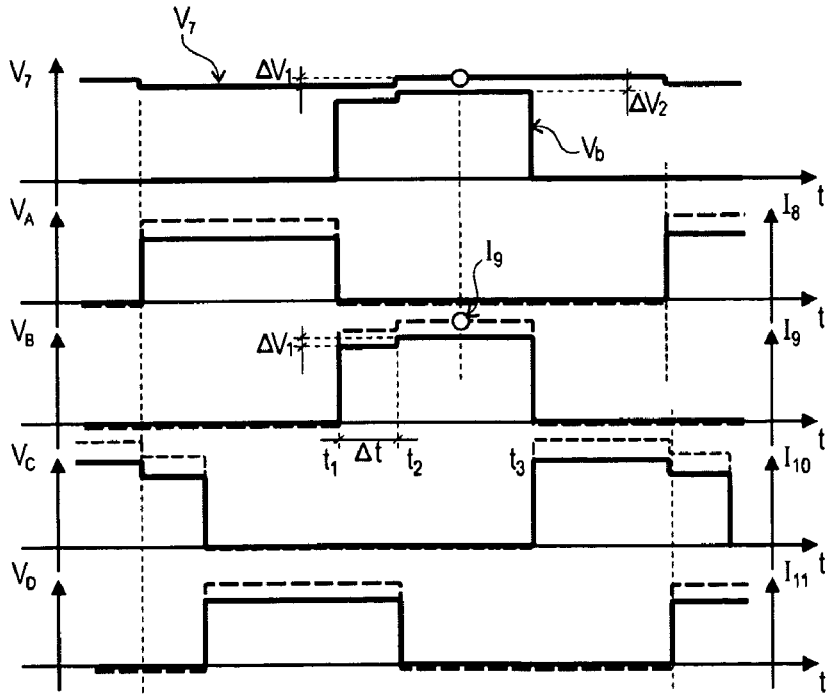
FIG. 9 shows the voltages at the glow plug during the start of the diesel engine.

FIG. 9 shows waveforms of the supply voltages during the switching of the high-side switches. The voltage at power supply node 204 is marked by V7, whereas the voltages VA, VB, VC and VD indicate the voltages at the respective glow plugs A, B, C and D. In the diagram of the voltage V7, the voltage VB is copied to demonstrate the difference ΔV1 of these voltages. In the diagrams for VA, VB, VC and VD, the respective currents I8, I9, I10 and I11 through the glow plugs A, B, C and D are drawn as dashed lines.

Voltage drops across the power supply wiring harness 106 due the commands overlaps affect the voltage being measured by the voltage monitor 7*a*. As a consequence, voltage steps on the monitored voltage affect the RMS value calculation but are not measured. The voltage at power supply node 204 is affected by the voltage drops across the wiring harness due the commands for the high-side switches. These commands partly overlap, meaning that at least two high side switches are switched on at the same time. During this time, the voltage at power supply node 204 drops by ΔV2. As a consequence, voltage steps on the monitored voltage affect the estimation of the RMS value calculation.

This is demonstrated by the signal V7 in FIG. 7. The voltage monitor 7*a* samples the voltage V7 at the power supply node 204 only once during the one on-period of the high-side switch control 23*a* for the glow plug B. The circle in the curve of the voltage V7 marks this sample. However, during the on-phase of the high-side switch of the glow plug B, the voltage V7 varies due to the command overlap with glow plug D. When both glow plugs are activated, the voltage V7 is reduced by ΔV1 compared to the time when only the glow plug B is activated. This change in the voltage is taken into account to calculate the real effective RMS (root mean square) of the driving signal.

In order to calculate the real RMS voltage, the values Vsample, max, Δt=t2−t1, of ΔV1 and ΔV2 are evaluated. The Vsample, min value is used for a coherency check with the maximal value.

Isample is measured by the current monitors 8*a*, 10*a*, 11*a*, 8*b*, 9*b*, 11*b* during the on/off periods of the PWM commands. The pulse width modulation duty cycles and the pulse width modulation shift are known from the PWM generator 507, such that the values for t1, t2 and t3 can be calculated. The calibration parameters identify the values of the wiring harness power supply input path and the glow plug wiring harness resistances. From these values Δt=t2−t1, ΔV1 and ΔV2 and the correct effective voltage at the glow plug B is evaluated.

The control method 1) compensates the air flow cooling effect and the combustion heat release by calibrating for engine operating condition in the thermal status estimation 503. In this block, the cooling due to thermal exchange inside the cylinder chamber during the engine cycle is taken into account and compared with nominal operating condition typically defined in still air.

The control method 1) estimates the initial thermal status of the glow plug by monitoring the time elapsed from last active period and the environmental operating condition. This period is correlated with a thermal decay model to estimate its thermal status of the glow plugs.

Figure 10:
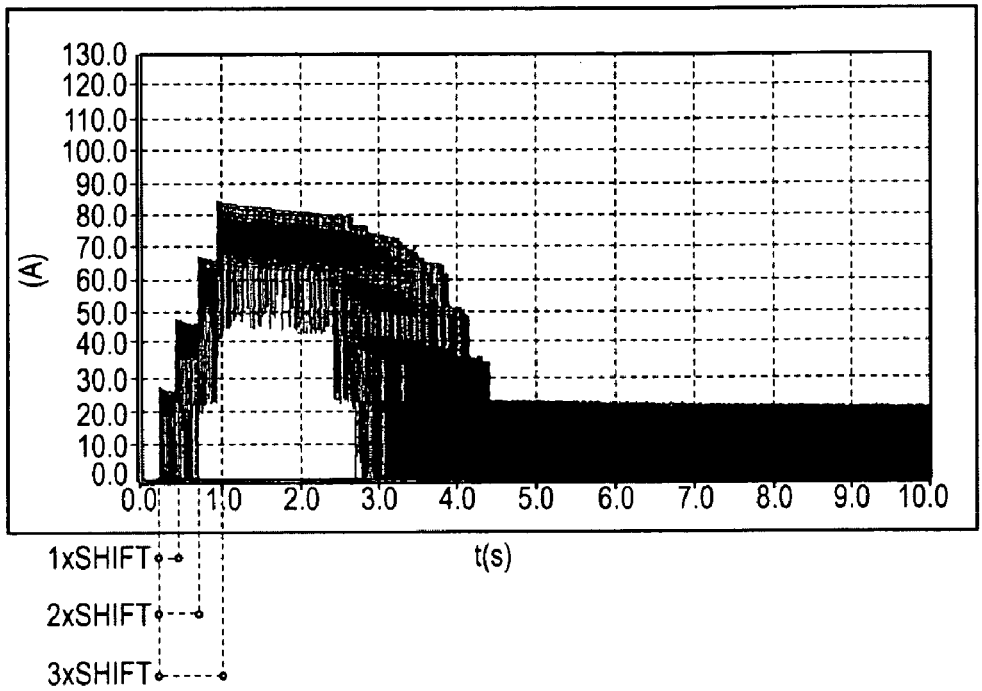
FIG. 10 shows a profile of the current through the glow plug.

FIG. 10 shows the total current from the battery into the glow plugs of a 4 cylinder engine during the inrush phase. According to the control method 1) the first glow plug is activated depending on the engine initial operating conditions. The other glow plugs are activated after the first glow plug. The delay between the activations of the different glow plugs limit the peak current overlap in the first unidirectional enable switch 5*a* and in the common wiring harness path in the wiring harness block 102. The inrush phase starts with cold glow plugs. The initial temperature is calculated by the time elapsed since the last active period of the engine and based on the environmental operation conditions. FIG. 10 shows that it is evident to activate the four glow plugs in a delayed manner to reduce the current peaks.

Figure 11:
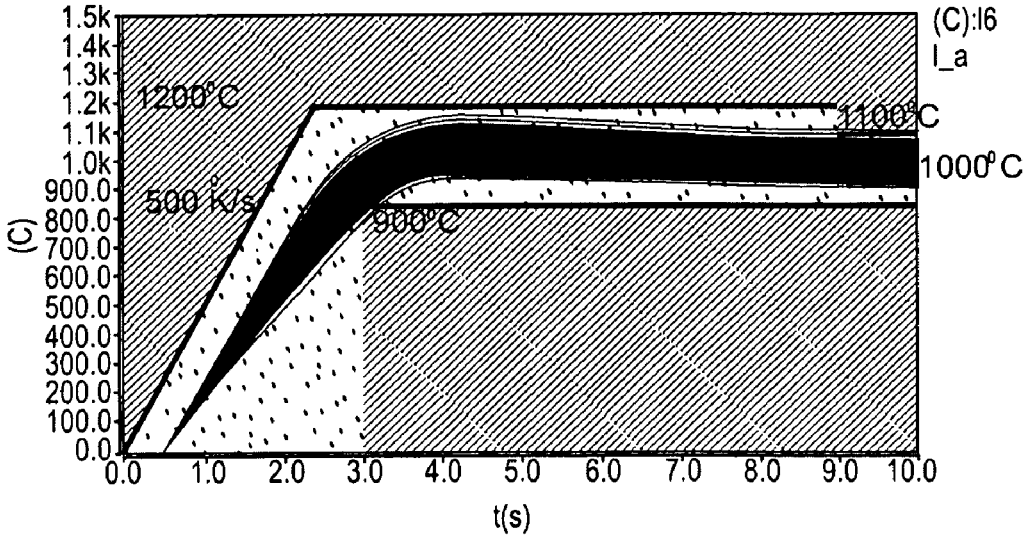
FIG. 11 shows the temperature profile of glow plugs.

FIG. 11 shows the temperature curves for a plurality of environmental conditions and battery voltages. Most of the curves are within the defined range. Some of them reach the minimum target temperature after 3.2 s and not after the specified 3 s, but this is not considered to be critical.

The control provides the capability to set the delays between the pulse width modulated commands during the temperature holding phase depending on the glowing operating conditions. The goal is to minimize the total effective current and the related EMC potential problems.

The glowing function is integrated inside the engine control module providing a unique solution for the complete management of the engine with an evident advantage on the cost. The glowing function integrated inside the engine control module provides a unique possibility to interact with all the other engine control functions offering a very flexible solution with easy adaptation to new requirements for the glowing subsystem, including new glow plug characteristics. The control architecture provides a redundant switch off functionality that permits to elimination of the external relay in a direct battery connection.

The control methods provide several solutions, applicable depending on the engine operating conditions and on the glow plug technology, to guarantee that target temperature is reached with acceptable accuracy.

The control methods provide different solutions, applicable depending on the engine operating conditions and on the electrical subsystem architecture, to compensate the effects of system parameters variations that could affect the overall temperature control accuracy and to improve the electromagnetic compatibility (EMC) of the vehicle electrical system.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A glow plug control unit, comprising:

a first switch adapted to connect a power supply node to a glow plug;

a pulse width modulated (PWM) parameter determination circuit adapted to determine a variable PWM duty cycle for a PWM signal to be provided to the first switch based on one or more electrical parameters selected from a group consisting of a current through the first switch and a voltage at the power supply node; and a circuit adapted to control the first switch by providing the PWM signal with the PWM duty cycle determined by the PWM parameter determination circuit.

2. The glow plug control unit according to claim 1, wherein the first switch comprises a transistor and the glow plug control unit further comprises a current mirror mirroring a current through the transistor of the first switch.

3. The glow plug control unit according to claim 1, further comprising a second switch between a battery and the power supply node.

4. The glow plug control unit according to claim 1, wherein the one or more electrical parameters also are measured when the first switch is switched off.

5. The glow plug control unit according to claim 1, further comprising a voltage control circuit, in a voltage control mode, that is adapted to regulate a voltage at the glow plug to a predetermined value.

6. The glow plug control unit according to claim 1, further comprising a power control unit, in a power control mode, that is adapted to regulate a power in the glow plug to a predetermined value.

7. The glow plug control unit according to claim 6, wherein the power in the glow plug is estimated based on the current through the first switch and based on the voltage at the power supply node.

8. The glow plug control unit according to claim 1, further comprising an inrush control unit which, in a inrush control mode, is adapted to regulate an energy supplied to the glow plug to the predetermined value.

9. The glow plug control unit according to claim 1, further comprising:

a second switch adapted to connect the power supply node to a second glow plug; and a second PWM parameter determination circuit adapted to determine a second variable PWM duty cycle for a second PWM signal to be provided to the second switch based on one or more electrical parameters selected from a group consisting of a current through the second switch and the voltage at the power supply node.

10. The glow plug control unit according to claim 9, further comprising a voltage estimation unit adapted to estimate a voltage at the glow plug by compensating a voltage drop at the power supply node resulting from the current through the second switch.

11. The glow plug control unit according to claim 1, further comprising:

a voltage estimation unit adapted to produce an estimated voltage at the power supply node, wherein the PWM parameter determination circuit comprises:

a divider adapted to divide the estimated voltage by a voltage set point to produce a result; and a PWM generator adapted to determine the PWM duty cycle based on the result.

12. The glow plug control unit according to claim 11, wherein the PWM parameter determination circuit further comprises:

an integrator adapted to produce an integrated result based on the estimated voltage; and a comparator adapted to compare the integrated result with a target value, and when the integrated result is less than the target value, to provide an output signal that affects the state of the switch.

13. The glow plug control unit according to claim 1, further comprising:

a current estimation unit adapted to produce an estimated current through the switch, wherein the PWM parameter determination circuit comprises:

a divider adapted to divide the estimated current by a current set point to produce a result; and a PWM generator adapted to determine the PWM duty cycle based on the result.

14. The glow plug control unit according to claim 1, further comprising:

a power estimation unit adapted to produce an estimated power based on a measured current through the switch and a measured voltage at the power supply node, wherein the PWM parameter determination circuit comprises:

a divider adapted to divide the estimated power by a power set point to produce a result; and a PWM generator adapted to determine the PWM duty cycle based on the result.

15. A method for controlling a glow plug, the method comprising:

receiving information describing one or more electrical parameters selected from a group consisting of a voltage at the power supply node and a current through a switch that is connected between the power supply node and the glow plug;

determining a variable pulse width modulated (PWM) duty cycle for a PWM signal to be provided to the switch based on the one or more electrical parameters; and controlling the first switch by providing the PWM signal with the PWM duty cycle to the switch.

16. The method according to claim 15, wherein determining the variable PWM duty cycle comprises the steps of:

receiving an estimated voltage at the power supply node;

dividing the estimated voltage by a voltage set point to produce a result; and determining the PWM duty cycle based on the result.

17. The method according to claim 15, wherein determining the variable PWM duty cycle comprises the steps of:

receiving an estimated current through the switch;

dividing the estimated current by a current set point to produce a result; and determining the PWM duty cycle based on the result.

18. The method according to claim 15, wherein determining the variable PWM duty cycle comprises the steps of:

receiving an estimated power based on a measured current through the switch and a measured voltage at the power supply node;

dividing the estimated power by a power set point to produce a result; and determining the PWM duty cycle based on the result.

19. A method for calculating a power applied to a glow plug, the method comprising the steps of:

providing a glow plug control unit for a plurality of glow plugs, the glow plug control unit comprising a plurality of switches, each of the plurality of switches for connecting a different glow plug of the plurality of glow plugs to a power supply node;

measuring a current through the glow plug;

calculating a voltage at the glow plug by calculating a voltage drop at the power supply node resulting from a current through the plurality of switches being switched on concurrently; and calculating the power based on the voltage at the glow plug and the current through the glow plug.

* * * * *